US009799280B2

(12) United States Patent
Shin et al.

(10) Patent No.: US 9,799,280 B2
(45) Date of Patent: Oct. 24, 2017

(54) LIQUID CRYSTAL DISPLAY

(71) Applicant: Samsung Display Co., Ltd., Yongin, Gyeonggi-Do (KR)

(72) Inventors: Beom-Soo Shin, Hwaseong-si (KR); Byoung-Hun Sung, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 28 days.

(21) Appl. No.: 14/482,157

(22) Filed: Sep. 10, 2014

(65) Prior Publication Data

US 2015/0213769 A1 Jul. 30, 2015

(30) Foreign Application Priority Data

Jan. 27, 2014 (KR) ..... 10-2014-0009695

(51) Int. Cl.
*G09G 3/36* (2006.01)

(52) U.S. Cl.
CPC ..... *G09G 3/3607* (2013.01); *G09G 3/3611* (2013.01); *G09G 3/3655* (2013.01); *G09G 2300/0426* (2013.01); *G09G 2300/0443* (2013.01); *G09G 2300/0447* (2013.01); *G09G 2320/028* (2013.01); *G09G 2320/0233* (2013.01); *G09G 2320/0247* (2013.01); *G09G 2320/0257* (2013.01)

(58) Field of Classification Search
USPC ..... 345/89, 690
See application file for complete search history.

(56) References Cited

U.S. PATENT DOCUMENTS

| | | | | |
|---|---|---|---|---|
| 7,545,356 | B2 | 6/2009 | HoeSup | |
| 2004/0178982 | A1* | 9/2004 | Chen | G09G 3/3648 345/100 |
| 2007/0279364 | A1* | 12/2007 | Moh | G09G 3/3688 345/100 |
| 2007/0290970 | A1* | 12/2007 | Liu | G09G 3/3648 345/89 |
| 2009/0251194 | A1 | 10/2009 | Morong | |
| 2009/0322664 | A1* | 12/2009 | Baek | G09G 3/006 345/94 |
| 2011/0221760 | A1 | 9/2011 | Irie et al. | |
| 2012/0007894 | A1* | 1/2012 | Shin | G09G 3/3648 345/690 |
| 2013/0044096 | A1 | 2/2013 | Kim et al. | |

FOREIGN PATENT DOCUMENTS

| | | | |
|---|---|---|---|
| JP | 4925371 | B2 | 2/2012 |
| KR | 100350598 | A | 8/2002 |
| KR | 100343513 | A | 5/2003 |
| KR | 1020030073071 | A | 9/2003 |
| KR | 100417181 | A | 1/2004 |
| KR | 100577300 | A | 4/2006 |

* cited by examiner

*Primary Examiner* — Carolyn R Edwards
*Assistant Examiner* — Deeprose Subedi
(74) *Attorney, Agent, or Firm* — Cantor Colburn LLP

(57) ABSTRACT

A liquid crystal display includes: a display panel including a plurality of pixels arranged substantially in a matrix form, a plurality of gate lines connected to the pixels, and a plurality of data lines connected to the pixels; and a common voltage generator configured to generate a common voltage and apply the common voltage to the display panel, in which the common voltage generated from the common voltage generator is substantially the same as an optimum common voltage at a highest grayscale level, which minimizes flicker at the highest grayscale level.

19 Claims, 14 Drawing Sheets

LIQUID CRYSTAL DISPLAY

This application claims priority to Korean Patent Application No. 10-2014-0009695 filed on Jan. 27, 2014, and all the benefits accruing therefrom under 35 U.S.C. §119, the content of which in its entirety is herein incorporated by reference.

BACKGROUND (a) Field

Exemplary embodiments of the invention relate to a liquid crystal display.

(b) Description of the Related Art

A liquid crystal display, which is one of the most widely used types of flat panel display, typically includes two panels on which field generating electrodes, such as a pixel electrode and a common electrode, are provided, and a liquid crystal layer disposed between the two panels. The liquid crystal display displays an image by applying voltage to the field generating electrodes to generate an electric field on the liquid crystal layer, thereby determining alignment of liquid crystal molecules of the liquid crystal layer through the generated electric field to control polarization of incident light.

The liquid crystal display may be easily manufactured to have thin thickness, but side visibility of the liquid crystal display is typically poor compared to front visibility. Accordingly, various methods of arranging and driving liquid crystal have been developed to improve the side visibility.

SUMMARY

A liquid crystal display, in which a pixel electrode and a common electrode are provided on one substrate, typically has a wide viewing angle. However, such a liquid crystal display may have different optimum common voltages between a white image and a black image, and a surface afterimage may be generated due to the difference.

Exemplary embodiments of the invention provide a liquid crystal display with minimized surface afterimage by applying an optimum common voltage measured at the highest grayscale level to a common electrode.

An exemplary embodiment of the invention provides a liquid crystal display including: a display panel including a plurality of pixels arranged substantially in a matrix form, a plurality of gate lines connected to the pixels and a plurality of data lines connected to the pixels; and a common voltage generator configured to generate a common voltage and apply the common voltage to the display panel, in which the common voltage generated from the common voltage generator is substantially the same as an optimum common voltage at a highest grayscale level, which minimizes flicker at the highest grayscale level.

In an exemplary embodiment, the common voltage generator may include a common voltage storage unit which stores a value of the optimum common voltage at the highest grayscale level.

In an exemplary embodiment, the optimum common voltage at the highest grayscale level stored in the common voltage storage unit may be an average value of optimum common voltages at the highest grayscale level measured at five positions of the display panel after the liquid crystal display is manufactured.

In an exemplary embodiment, a difference between the optimum common voltage measured at the highest grayscale level and an optimum common voltage measured at a grayscale level lower than the highest grayscale level may be equal to or smaller than about 0.3 volts (V).

In an exemplary embodiment, the optimum common voltage measured at the highest grayscale level may be lower than the optimum common voltage measured at the grayscale level lower than the highest grayscale level.

In an exemplary embodiment, the highest grayscale level may be a grayscale level of 64.

In an exemplary embodiment, the highest grayscale level may be a grayscale level of 256.

In an exemplary embodiment, the highest grayscale level may be a grayscale level of 1024.

In an exemplary embodiment, when the liquid crystal display displays the highest grayscale level, a residual direct current ("DC") in the display panel is substantially zero (0).

In an exemplary embodiment, when the liquid crystal display displays the highest grayscale level, a surface afterimage may not be shown.

In an exemplary embodiment, the liquid crystal display may further include: a gray voltage generator configured to generate a plurality of gray voltages; and a data driver configured to apply a gray voltage corresponding to an image signal among the gray voltages to the pixels as a data voltage.

Another exemplary embodiment of the invention provides a method of determining an optimum common voltage of a display apparatus, the method including: applying a highest grayscale level to the display apparatus; applying a common voltage to the display apparatus, to which the highest grayscale level is applied; measuring a value of the common voltage, at which a flicker is minimum, at a plurality of points of the display apparatus while adjusting the common voltage; and averaging values of the common voltage measured at the points, respectively.

In an exemplary embodiment, the points may be five points in a display panel of the display apparatus.

In an exemplary embodiment, the highest grayscale level may be a grayscale level of 64.

In an exemplary embodiment, the highest grayscale level may be a grayscale level of 256.

In an exemplary embodiment, the highest grayscale level may be a grayscale level of 1024.

In an exemplary embodiment, the method may further include storing the averaged value of the common voltage in a common voltage storage unit of the display apparatus.

According to exemplary embodiments of the liquid crystal display according to the invention, an optimum common voltage measured at the highest grayscale level is applied to a common electrode as a common voltage, thereby minimizing a surface afterimage of the liquid crystal display.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
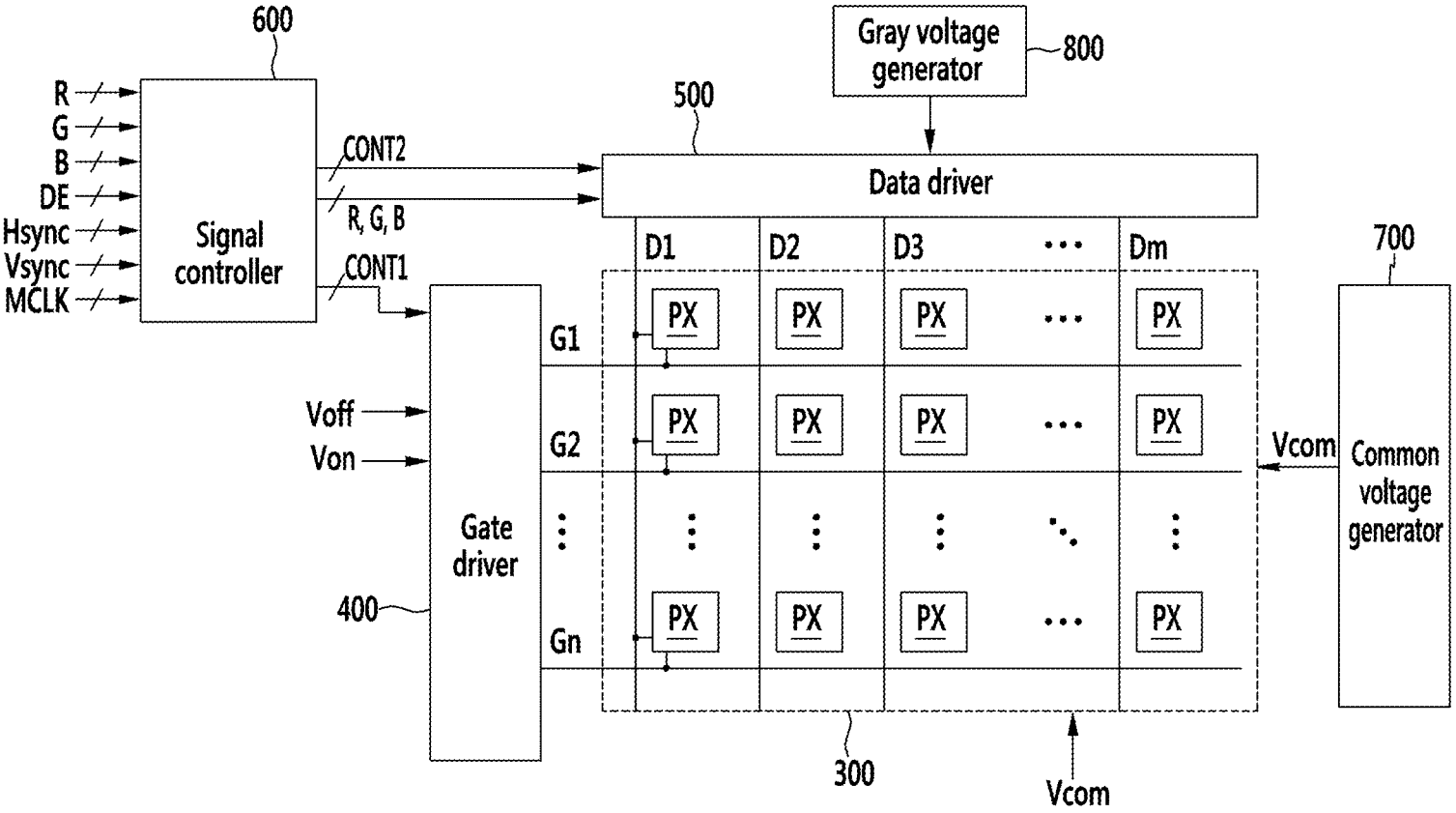
FIG. 1 is a block diagram illustrating an exemplary embodiment of a liquid crystal display according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of a liquid crystal display according to the invention will be described in detail with reference to the accompanying drawings.

First, an exemplary embodiment of a liquid crystal display according to the invention will be described in detail with reference to FIGS. 1 and 2.

Figure 2:
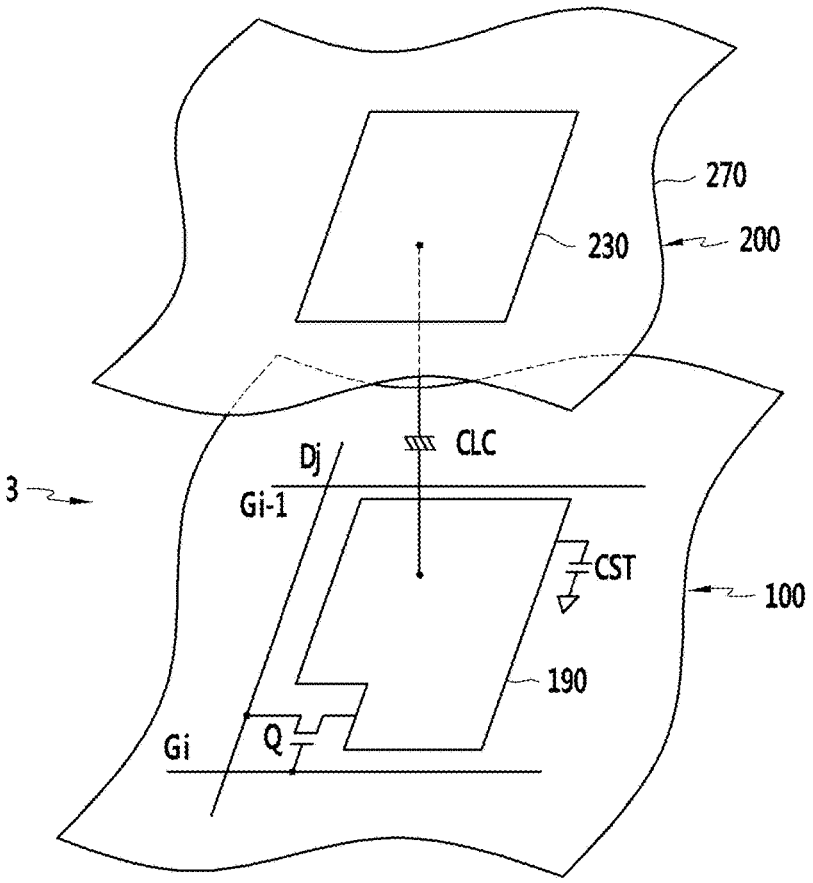
FIG. 2 is an equivalent circuit diagram of a pixel in an exemplary embodiment of the liquid crystal display according to the invention.

FIG. 1 is a block diagram illustrating an exemplary embodiment of a liquid crystal display according to the invention, and FIG. 2 is an equivalent circuit diagram of a pixel in an exemplary embodiment of the liquid crystal display according to the invention.

Referring to FIG. 1, an exemplary embodiment of the liquid crystal display, according to the invention, includes a display panel, that is, a liquid crystal panel assembly 300, a gate driver 400, a data driver 500, a gray voltage generator 800, a signal controller 600, and a common voltage generator 700.

Referring to FIG. 1, the liquid crystal panel assembly 300 includes a plurality of signal lines G1 to Gn and D1 to Dm, and a plurality of pixels PX connected to the plurality of signal lines and arranged substantially in a matrix form, in terms of an equivalent circuit. In such an embodiment, referring to a structure illustrated in FIG. 2, the liquid crystal panel assembly 300 includes lower and upper panels 100 and 200, which face each other, and a liquid crystal layer 3 interposed therebetween.

The signal lines G1 to Gn and D1 to Dm include a plurality of gate lines G1 to Gn for transferring a gate signal (also referred to as a "scan signal") and a plurality of data lines D1 to Dm for transferring a data voltage. The gate lines G1 to Gn extend substantially in a row direction and are substantially parallel to each other, and the data lines D1 to Dm extend substantially in a column direction and are substantially parallel to each other.

Each pixel PX, for example, a pixel PX that is connected to an i-th (i=1, 2, . . . , and n) gate line Gi and a j-th (j=1, 2, . . . , and m) data line Dj, includes a switching element Q that is connected to the signal lines Gi and Dj, and a liquid crystal capacitor Clc and a storage capacitor Cst connected to the switching element Q. In an alternative exemplary embodiment, the storage capacitor Cst may be omitted.

The switching element Q may be a three terminal element, such as a thin film transistor that is provided on the lower panel 100, including a control terminal connected to the gate line Gi, an input terminal connected to the data line Dj, and an output terminal connected to the liquid crystal capacitor Clc and the storage capacitor Cst.

The liquid crystal capacitor Clc includes a pixel electrode 190 of the lower panel 100 and a common electrode 270 of the upper panel 200 as two terminals thereof, and the liquid crystal layer 3 between the two electrodes 191 and 270 as a dielectric material. The pixel electrode 190 is connected to the switching element Q, and the common electrode 270 is disposed to cover substantially an entire surface of the upper panel 200, and receives a common voltage Vcom. In an alternative exemplary embodiment, the common electrode 270 may be disposed on the lower panel 100, and in such an embodiment, at least one of the two electrodes 191 and 270 may have a line shape or a rod shape.

In an exemplary embodiment, the storage capacitor that auxiliary functions as the liquid crystal capacitor Clc be defined by a separate signal line (not illustrated) provided on the lower panel 100 and the pixel electrode 190 that overlaps the separate signal line with the insulating material interposed therebetween, and a predetermined voltage, such as common voltage Vcom, may be applied to the separate signal line. In an alternative exemplary embodiment, the storage capacitor may be defined by the pixel electrode 190 and a portion of a previous gate line Gi-1 disposed to overlap the pixel electrode 190 with the insulating material interposed therebetween.

In an exemplary embodiment, each pixel PX displays a predetermined color of primary colors (spatial division) or alternately displays the primary colors according to a time (temporal division), such that a desired color is recognized by a spatial and temporal sum of the primary colors. In one exemplary embodiment, for example, the primary color may include three primary colors, such as red, green and blue. In an exemplary embodiment, as shown in FIG. 2, where a color display is implemtned by the spatial division, each pixel PX includes a color filter 230 of one of the primary colors in a region of the lower panel 100 corresponding to the pixel electrode 190. The color filter 230 may include or be formed of an organic insulating layer.

A polarizer (not illustrated) is disposed in the liquid crystal panel assembly 300.

Figure 12:
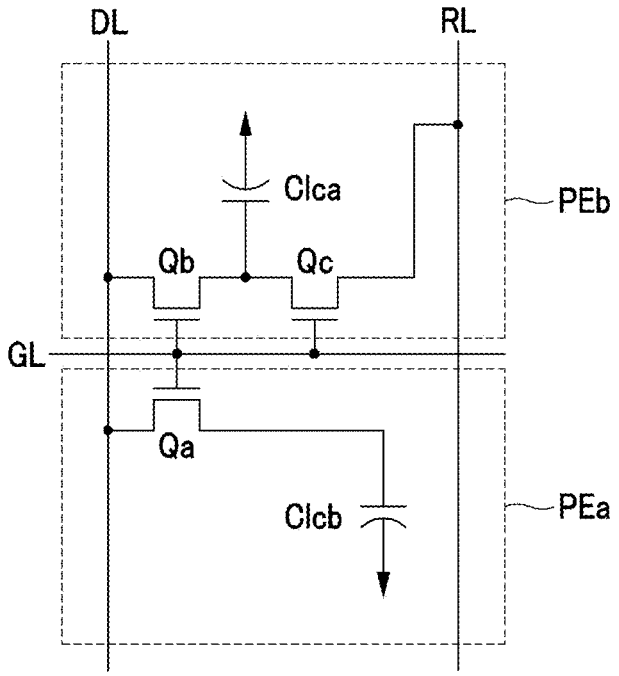
FIG. 12 is an equivalent circuit diagram of a pixel of an exemplary embodiment of the liquid crystal display according to the invention.

Then, a disposition of the signal lines and the pixel, and a driving method of the liquid crystal display, according to the invention, will be described with reference to FIG. 12. FIG. 12 is an equivalent circuit diagram of a pixel of an exemplary embodiment of the liquid crystal display according to the invention.

Referring to FIG. 12, a pixel PX of an exemplary embodiment of the liquid crystal display includes a plurality of signal lines including a gate line GL for transferring a gate signal, a data line DL for transferring a data signal, and a voltage division reference voltage line RL for transferring a voltage division reference voltage, first, second and third switching elements Qa, Qb and Qc, and first and second liquid crystal capacitors Clca and Clcb connected to the plurality of signal lines.

The first and second switching elements Qa and Qb are connected to the gate line GL and the data line DL, respectively, and the third switching element Qc is connected to an output terminal of the second switching element Qb and the voltage division reference voltage line RL.

The first switching element Qa and the second switching element Qb may be three terminal elements, such as a thin film transistor, control terminals thereof are connected to the gate line GL, input terminals thereof are connected to the data line DL, an output terminal of the first switching element Qa is connected to a first liquid crystal capacitor Clca, and an output terminal of the second switching element Qb is connected to a second liquid crystal capacitor Clcb and an input terminal of the third switching element Qc.

The third switching element Qc may be a three terminal element, such as a thin film transistor, and a control terminal thereof is connected to the gate line GL, the input terminal thereof is connected to the second liquid crystal capacitor Clcb, and an output terminal thereof is connected to the voltage division reference voltage line RL.

When a gate on signal is applied to the gate line GL, the first switching element Qa, the second switching element Qb and the third switching element Qc connected to the gate line GL are turned on. Accordingly, a data voltage applied to the data line DL is applied to a first subpixel electrode PEa and a second subpixel electrode PEb through the turned-on first and second switching elements Qa and Qb. In such an embodiment, the data voltages applied to the first subpixel electrode PEa and the second subpixel electrode PEb are substantially the same as each other, and the first liquid crystal capacitor Clca and the second liquid crystal capacitor Clcb are charged by substantially the same value corresponding to a difference between the common voltage and the data voltage. In such an embodiment, the voltage charged in the second liquid crystal capacitor Clcb is divided through the turned-on third switching element Qc. Accordingly, the voltage value charged in the second liquid crystal capacitor Clcb is decreased by a difference between the common voltage and the voltage division reference voltage, such that the voltage charged in the first liquid crystal capacitor Clca is higher than a voltage charged in the second liquid crystal capacitor Clcb.

As described above, in an exemplary embodiment, the voltage charged in the first liquid crystal capacitor Clca and the voltage charged in the second liquid crystal capacitor Clcb become different from each other. In such an embodiment, the voltage of the first liquid crystal capacitor Clca and the voltage of the second liquid crystal capacitor Clcb are different from each other, and inclination angles of liquid crystal molecules in the first subpixel and the second subpixel thereby become different from each other, such that luminance of the two subpixels become different from each other. Accordingly, when the voltage of the first liquid crystal capacitor Clca and the voltage of the second liquid crystal capacitor Clcb are appropriately adjusted, an image recognized at a lateral side may become substantially close, e.g., as close as possible, to an image recognized at a front side, thereby improving lateral side visibility.

In an exemplary embodiment, as shown in FIG. 12, the liquid crystal display includes the third switching element Qc connected to the second liquid crystal capacitor Clcb and the voltage division reference voltage line RL to allow the voltage charged in the first liquid crystal capacitor Clca and the voltage charged in the second liquid crystal capacitor Clcb to be different form each other, but the invention is not limited thereto. In an alternative exemplary embodiment of a liquid crystal display according to the invention, the second liquid crystal capacitor Clcb may be connected to a step-down capacitor. In such an embodiment, the liquid crystal display may include a third switching element Qc including a first terminal connected to a step-down gate line, a second terminal connected to the second liquid crystal capacitor Clcb and a third terminal connected to the step-down capacitor, and a part of the amount of charge charged in the second liquid crystal capacitor Clcb is charged in the step-down capacitor, such that the charging voltages between the first liquid crystal capacitor Clcb and the second liquid crystal capacitor Clcb may be differently set from each other. In another alternative exemplary embodiment of a liquid crystal display according to the invention, the first liquid crystal capacitor Clca and the second liquid crystal capacitor Clcb may be connected to different data lines, and receive different data voltages, such that the charging voltages between the first liquid crystal capacitor Clca and the second liquid crystal capacitor Clcb may be differently set from each other. In an exemplary embodiment, the charging voltages between the first liquid crystal capacitor Clca and the second liquid crystal capacitor Clcb may be differently set by other various methods or through other various configurations.

Figure 13:
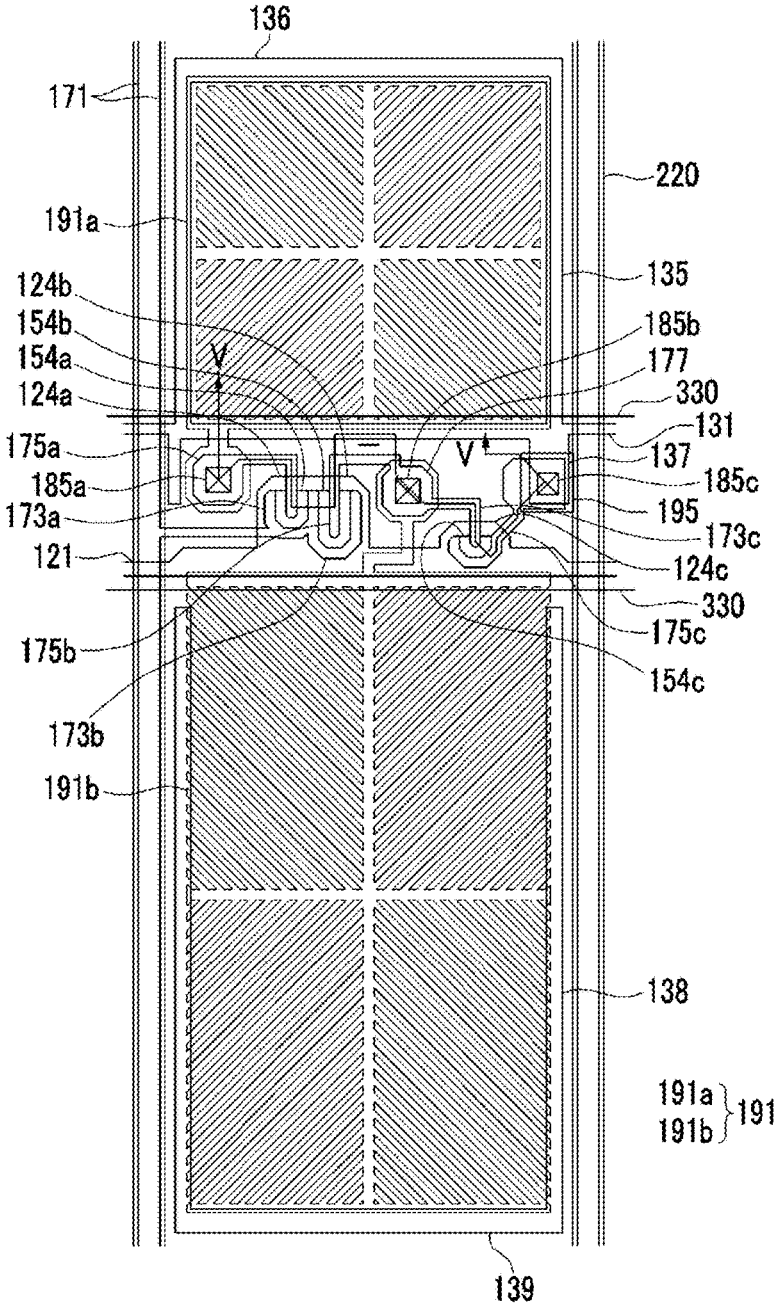
FIG. 13 is a plan view of a pixel of an exemplary embodiment of the liquid crystal display according to the invention.

Then, a structure of an exemplary embodiment of the liquid crystal display illustrated in FIG. 12 will be briefly described with reference to FIGS. 13 and 14. FIG. 13 is a plan view of a pixel of an exemplary embodiment of the liquid crystal display according to the invention, and FIG. 14 is a cross-sectional view taken along line V-V of the liquid crystal display in FIG. 13.

Figure 14:
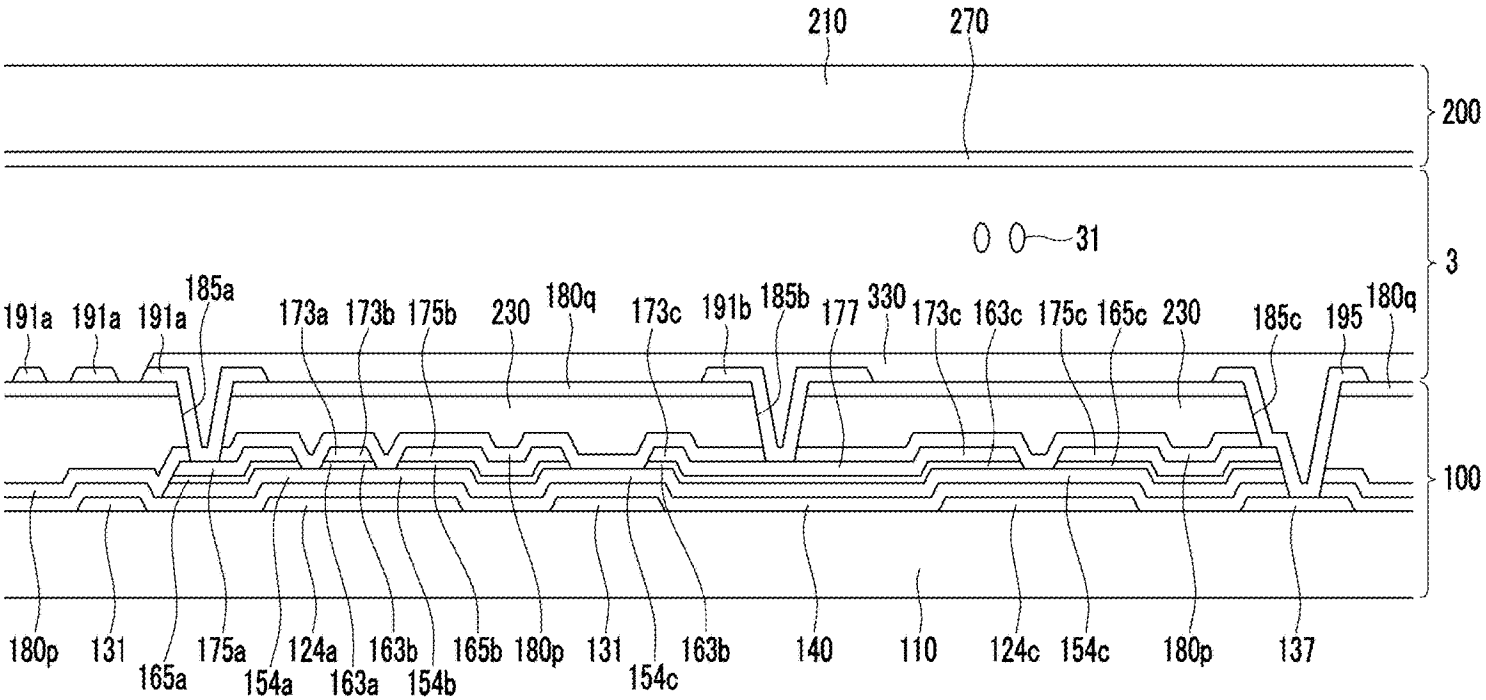
FIG. 14 is a cross-sectional view taken along line V-V of the liquid crystal display in FIG. 13.

First, referring to FIGS. 13 and 14, an exemplary embodiment of the liquid crystal display includes the lower panel 100 and the upper panel 200 which face each other, the liquid crystal layer 3 interposed between the two panels 100 and 200, and a pair of polarizers (not illustrated) attached at outer surfaces of the lower and upper panels 100 and 200, respectively.

First, the lower panel 100 will be described.

In an exemplary embodiment, the lower panel 100 includes an insulating substrate 110 including a transparent material such as glass, plastics or the like, for example. In such an embodiment, a gate conductor, including a gate line 121 and a voltage division reference voltage line 131, is disposed on the insulating substrate 110.

The gate line 121 includes a first gate electrode 124*a*, a second gate electrode 124*b*, a third gate electrode 124*c* and a wide end portion (not illustrated) for connection to another layer or an external driving circuit.

The voltage division reference voltage line 131 includes first storage electrodes 135 and 136, and a reference electrode 137. Second storage electrodes 138 and 139, which are not connected to the voltage division reference voltage line 131 but overlap the second subpixel electrode 191*b*, are disposed on the lower panel 100.

A gate insulating layer 140 is disposed on the gate line 121 and the voltage division reference voltage line 131.

A first semiconductor 154*a*, a second semiconductor 154*b* and a third semiconductor 154*c* are disposed on the gate insulating layer 140.

A plurality of ohmic contacts 163*a*, 165*a*, 163*b*, 165*b*, 163*c* and 165*c* is disposed on the semiconductors 154*a*, 154*b* and 154*c*.

Data conductors include a plurality of data lines 171, a first drain electrode 175*a*, a second drain electrode 175*b*, a third source electrode 173*c* and a third drain electrode 175*c*, are disposed on the ohmic contacts 163*a*, 165*a*, 163*b*, 165*b*, 163*c* and 165*c*, and the gate insulating layer 140. The data lines 171 include a first source electrode 173*a* and a second source electrode 173*b*.

The data conductors, and the semiconductors and the ohmic contacts disposed under the data conductors, may be simultaneously provided, e.g., formed, using a same mask, e.g., a single mask.

The data line 171 includes a wide end portion (not illustrated) for connection with another layer or an external driving circuit.

In an exemplary embodiment, the first gate electrode 124*a*, the first source electrode 173*a* and the first drain electrode 175*a* form a first thin film transistor Qa together with a first semiconductor island 154*a*, and a channel of the thin film transistor is formed at the semiconductor 154*a* between the first source electrode 173*a* and the first drain electrode 175*a*. In such an embodiment, the second gate electrode 124*b*, the second source electrode 173*b* and the second drain electrode 175*b* form a second thin film transistor Qb together with a second semiconductor island 154*b*, and a channel of the thin film transistor is formed at the semiconductor 154*b* between the second source electrode 173*b* and the second drain electrode 175*b*. In such an embodiment, the third gate electrode 124*c*, the third source electrode 173*c* and the third drain electrode 175*c* form a third thin film transistor Qc together with a third semiconductor island 154*c*, and a channel of the thin film transistor is formed at the semiconductor 154*c* between the third source electrode 173*c* and the third drain electrode 175*c*.

The second drain electrode 175*b* is connected to the third source electrode 173*c*, and includes an extended portion 177 having an extended area.

A first passivation layer 180*p* is disposed on the data conductors 171, 173*c*, 175*a*, 175*b* and 175*c* and exposed portions of the semiconductors 154*a*, 154*b* and 154*c*. The first passivation layer 180*p* may include an inorganic insulating layer, such as nitride oxide or silicon oxide, for example. The first passivation layer 180*p* may effectively prevent pigment of the color filter 230 from flowing into the exposed portions of the semiconductors 154*a*, 154*b* and 154*c*.

In an exemplary embodiment, as shown in FIG. 14, the color filter 230 is disposed on the first passivation layer 180*p*. The color filter 230 may extend substantially in a vertical direction along two adjacent data lines. A first light blocking member 220 is disposed on the first passivation layer 180*p*, an edge of the color filter 230 and the data line 171.

The first light blocking member 220 extends substantially in an extending direction of the data line 171, and is disposed between two adjacent color filters 230 in a horizontal direction. A width of the first light blocking member 220 may be greater than a width of the data line 171. As described above, the width of the first light blocking member 220 is larger than the width of the data line 171, such that the first light blocking member 220 may effectively prevent light incident from the outside from being reflected from a surface of the metal data line 171. Accordingly, the light reflected from the surface of the data line 171 interferes in light passing through the liquid crystal layer 3, thereby effectively preventing a contrast ratio of the liquid crystal display from being decreased.

In such an embodiment, a second passivation layer 180*q* is disposed on the color filter 230 and first light blocking member 220.

The second passivation layer 180*q* may include an inorganic insulating layer, such as nitride oxide or silicon oxide, for example. The second passivation layer 180*q* effectively prevents the color filter 230 from being peeled, and suppresses contamination of the liquid crystal layer 3 by an organic material, such as a solvent, flowing in from the color filter 230, thereby effectively preventing defects, such as an afterimage, that may occur when a screen is driven.

A first contact hole 185*a* and a second contact hole 185*b*, which expose the first drain electrode 175*a* and the second drain electrode 175*b*, respectively, are defined or formed through the first passivation layer 180*p*, the color filter 230 and the second passivation layer 180*q*, respectively.

A third contact hole 185*c* that exposes a part of the reference electrode 137 and a part of the third drain electrode 175*c* is defined or formed through the first passivation layer 180*p*, the color filter 230, the second passivation layer 180*q* and the gate insulating layer 140, and the third contact hole 185*c* is covered by a connecting member 195. The connecting member 195 electrically connects the reference electrode 137 and the third drain electrode 175*c* exposed through the third contact hole 185*c*.

A plurality of pixel electrodes 191 is disposed on the second passivation layer 180*q*. Each pixel electrode 191 includes a first subpixel electrode 191*a* and a second subpixel electrode 191*b*, which are spaced apart or separated from each other with the gate line 121 interposed therebetween, and are adjacent in a column direction (e.g., the vertical direction) based on the gate line 121. The pixel electrode 191 may include or be made of a transparent material, such as indium tin oxide ("ITO") or indium zinc oxide ("IZO"), for example. The pixel electrode 191 may include or be made of a transparent conductive material, such as ITO or IZO, or reflective metal, such as aluminum, silver, chromium, or an alloy thereof, for example.

Figure 15:
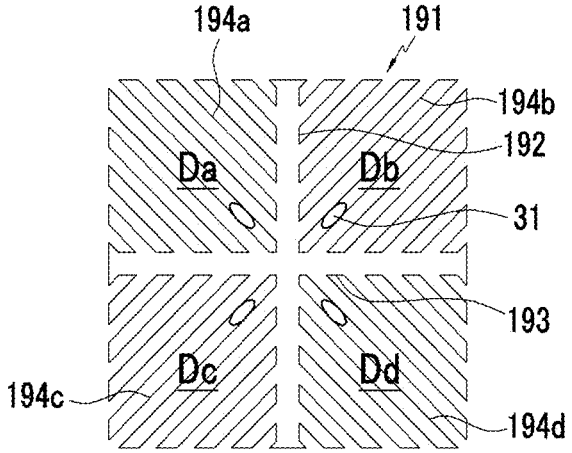
FIG. 15 is a top plan view illustrating a unit electrode of an exemplary embodiment of the liquid crystal display according to the invention.

Each of the first subpixel electrode 191*a* and the second subpixel electrode 191*b* includes one or more unit electrodes illustrated in FIG. 15, or a modification of the unit electrode.

The first subpixel electrode 191*a* and the second subpixel electrode 191*b* are physically and electrically connected to the first drain electrode 175*a* and the second drain electrode 175*b* through the first contact hole 185*a* and the second contact hole 185*b*, respectively, and receive the data voltage from the first drain electrode 175*a* and the second drain electrode 175*b*, respectively. In such an embodiment, a part of the data voltage applied to the second drain electrode 175*b* is divided through the third source electrode 173*c*, such that the voltage applied to the first subpixel electrode 191*a* may be greater than the voltage applied to the second subpixel electrode 192*b*.

The first subpixel electrode 191*a* and the second subpixel electrode 191*b*, to which the data voltage is applied, generate an electric field with the common electrode 270 of the upper panel 200 to determine a direction of the liquid crystal molecule of the liquid crystal layer 3 between two electrodes 191 and 270. The luminance of light passing through the liquid crystal layer 3 is changed based on the determined direction of the liquid crystal molecule by the electric field.

A second light blocking member 330 is disposed on the pixel electrode 191. The second light blocking member 330 covers all of the regions, in which the first transistor Qa, the second transistor Qb, the third transistor Qc, and the first to third contact holes 185*a*, 185*b* and 185*c* are disposed, and extends substantially in the same direction as the gate line 121 to cross the data line 171. The second light blocking member 330 may overlap at least a part of the two data lines 171, which are positioned at both sides of a region of a pixel, to effectively prevent light leakage generated at the vicinity of the data line 171 and the gate line 121, and to effectively prevent light leakage at the region in which the first transistor Qa, the second transistor Qb and the third transistor Qc are disposed.

In an exemplary embodiment, before providing the second light blocking member 330, the first passivation layer 180*p*, the color filter 230 and the second passivation layer 180*q* may be provided in the regions, in which the first transistor Qa, the second transistor Qb, the third transistor Qc, and the first to third contact holes 185*a*, 185*b* and 185*c* are provided, such that the positions of the first transistor Qa, the second transistor Qb, the third transistor Qc, and the first to third contact holes 185*a*, 185*b* and 185*c* are effectively determined.

Next, the upper panel 200 will be described.

In an exemplary embodiment, the upper panel 200 includes an insulating substrate 210, and the common electrode 270 disposed on the insulating substrate 210. In such an embodiment, an upper alignment layer (not illustrated) is disposed on the common electrode 270. The upper alignment layer may be a vertical alignment layer.

The liquid crystal layer 3 has negative dielectric anisotropy, and the liquid crystal molecules of the liquid crystal layer 3 are aligned in a predetermined direction such that longitudinal axes thereof are substantially vertical to the surfaces of the two panels 100 and 200 in a state where no electric field is generated.

Then, a unit electrode 199 of the first subpixel electrode 191*a* and the second subpixel electrode 191*b* will be described in greater detail with reference to FIG. 15.

In an exemplary embodiment, as illustrated in FIG. 15, a general shape of the unit electrode 199 is a quadrangle, and includes a cross-shaped stem portion including a horizontal stem portion 193, and a vertical stem portion 192 crossing the horizontal stem portion 193. In such an embodiment, the unit electrode 199 is divided into a first subregion Da, a second subregion Db, a third subregion Dc and a fourth subregion Dd by the horizontal stem portion 193 and the vertical stem portion 192, and each of the subregions Da to Dd includes a plurality of the first fine branch portion 194*a*, a plurality of the second fine branch portion 194*b*, a plurality of the third fine branch portion 194*c*, and a plurality of the fourth fine branch portion 194*d*.

In an exemplary embodiment, as shown in FIG. 15, the first fine branch portion 194*a* extends obliquely in an upper left direction from the horizontal stem portion 193 or the vertical stem portion 192, and the second fine branch portion 194*b* extends obliquely in an upper right direction from the horizontal stem portion 193 or the vertical stem portion 192. In such an embodiment, the third fine branch portion 194*c* extends in a lower left direction from the horizontal stem portion 193 or the vertical stem portion 192, and the fourth fine branch portion 194*d* extends obliquely in a lower right direction from the horizontal stem portion 193 or the vertical stem portion 192.

In an exemplary embodiment, the first to fourth fine branch portions 194*a*, 194*b*, 194*c* and 194*d* form an angle of approximately 45° or 135° with gate lines 121*a* and 121*b* or the horizontal stem portion 193. In such an embodiment, the fine branch portions 194*a*, 194*b*, 194*c* and 194*d* of the two adjacent subregions Da, Db, Dc and Dd may be substantially orthogonal to each other.

Widths of the fine branch portions 194*a*, 194*b*, 194*c* and 194*d* may be in the range of about 2.5 micrometers (μm) to about 5.0 μm and a gap between the adjacent fine branch portions 194*a*, 194*b*, 194*c* and 194*d* in a subregions Da, Db, Dc or Dd may be in the range of about 2.5 μm to about 5.0 μm.

According to another exemplary embodiment of the invention, the widths of the fine branch portions 194*a*, 194*b*, 194*c* and 194*d* may be increased as being closer to the horizontal stem portion 193 or the vertical stem portion 192, and a difference between the widest portion and the narrowest portion in a fine branch portion 194*a*, 194*b*, 194*c* or 194*d* may be in the range of about 0.2 μm to about 1.5 μm.

Figure 4:
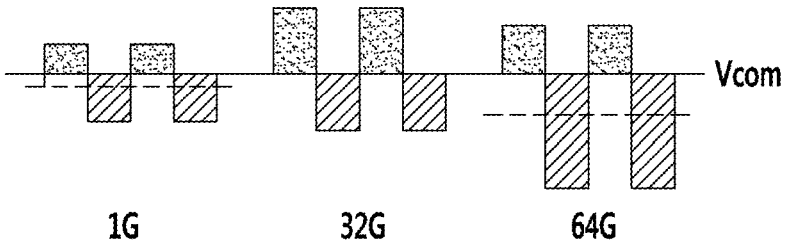
FIG. 4 is a diagram illustrating an optimum common voltage change in a comparative embodiment of a liquid crystal display.

In an exemplary embodiment, the first subpixel electrode 191*a* and the second subpixel electrode 191*b* are connected to the first drain electrode 175*a* and the second drain electrode 175*b* through the first contact hole 185*a* and the second contact hole 185*b*, respectively, and receive the data voltage from the first drain electrode 175*a* and the second drain electrode 175*b*, respectively. In such an embodiment, sides of the first to the fourth fine branch portions 194*a*, 194*b*, 194*c* and 194*d* distort an electric field and generate a horizontal component that determines an inclination direction of the liquid crystal molecules 31. The horizontal component of the electric field is substantially horizontal to the sides of the first to fourth fine branch portions 194*a*, 194*b*, 194*c* and 194*d*. Accordingly, as illustrated in FIG. 4, the liquid crystal molecules 31 are inclined in a direction substantially parallel to the longitudinal direction of the fine branch portions 194*a*, 194*b*, 194*c* and 194*d*. In an exemplary embodiment, as shown in FIGS. 13 and 15, each of the first and second pixel electrodes 191*a* and 191*b* includes one unit electrode 199 including four subregions Da to Dd, in which longitudinal directions of the fine branch portions 194*a*, 194*b*, 194*c* and 194*d* are different from each other, the directions in which the liquid crystal molecules 31 are inclined are about four directions. Accordingly, in such an embodiment, four domains, in which the alignment directions of the liquid crystal molecules 31 are different from each other, are formed in the liquid crystal layer 3. In such an embodiment, as described above, the inclination direction of the liquid crystal molecules is diversified, such that a reference viewing angle of the liquid crystal display is increased.

Then, an exemplary embodiment of a method of initially aligning the liquid crystal molecules 31 to have a pretilt will be described.

In an exemplary embodiment, a prepolymer is included in the alignment layer, such that the liquid crystal molecules have a pretilt.

In such an embodiment, the prepolymer, such as monomer, hardened by polymerization by light, such as ultraviolet rays, is included in the alignment layer. The prepolymer may be a reactive mesogen polymerized by light, such as ultraviolet rays.

Next, the data voltage is applied to the first subpixel electrode and the second subpixel electrode, and the common voltage is applied to the common electrode of the upper panel to generate an electric field in the liquid crystal layer between the two panels, e.g., the lower and upper panels 100 and 200. Then, the liquid crystal molecules of the liquid crystal layer are inclined in a direction substantially parallel to the longitudinal direction of the fine branch portions 194*a*, 194*b*, 194*c* and 194*d* in response to the electric field as described above, and the total number of directions in which the liquid crystal molecules 31 are inclined in a pixel is four.

When light, e.g., ultraviolet rays, is irradiated after the electric field is generated in the liquid crystal layer, the prepolymer is polymerized to form a polymer. The polymer may be provided to be in contact with the lower or upper panel 100 or 200. The alignment direction of the liquid crystal molecules is determined to have the pretilt in the aforementioned direction by the polymer. Accordingly, the liquid crystal molecules are arranged to have the pretilt in four different directions even in a state where a voltage is not applied to the field generating electrodes.

Then, a driving device of an exemplary embodiment of the liquid crystal display according to the invention will now be described in greater detail.

Referring back to FIG. 1, the gray voltage generator 800 generates entire gray voltages for grayscales to be displayed by the pixel, that is, related to transmittance of the pixel PX, or limited number of gray voltages. The gray voltage may have a voltage having a positive value and a voltage having a negative value with respect to the common voltage Vcom.

The gate driver 400 is connected to the gate lines G1 to Gn of the liquid crystal panel assembly 300, and applies the gate signal generated based on a combination of a gate-on voltage Von and a gate-off voltage Voff to the gate lines G1 to Gn.

The data driver 500 is connected to the data line D1 to Dm of the liquid crystal panel assembly 300, and selects a gray voltage from the gray voltage generator 800 and applies the selected gray voltage to the data line D1 to Dm as the data voltage. In an exemplary embodiment, where the gray voltage generator 800 does not provide all of the gray voltages, but provides a portion of all of the gray voltages, the data driver 500 divides the received gray voltage and generates the data voltage based on the divided gray voltages.

The signal controller 600 controls the gate driver 400, the data driver 500, and the like.

The common voltage generator 700 generates the common voltage Vcom, and supplies the generated common voltage Vcom to the common electrode 270 of the liquid crystal panel assembly 300. In an exemplary embodiment of the invention, the common voltage Vcom generated by the common voltage generator 700 is an optimum common voltage for the highest gray scale level of an input image signal. The common voltage Vcom will be described later in greater detail.

The driving devices 400, 500, 600, 700 and 800 may be each directly disposed, e.g., mounted, on the liquid crystal panel assembly 300 in a form of an integrated circuit ("IC") chip, may be mounted on a flexible printed circuit film (not illustrated) to be attached to the liquid crystal panel assembly 300 in a tape carrier package ("TCP") form, or may be mounted on a separate printed circuit board ("PCB") (not illustrated). In an alternative exemplary embodiment, the driving devices 400, 500, 600, 700 and 800 may be integrated on the liquid crystal panel assembly 300 together with the signal lines G1 to Gn, and D1 to Dm and the thin film transistor switching element. In another alternative exemplary embodiment, the driving devices 400, 500, 600, 700 and 800 may be integrated in a single chip, and in such an embodiment, at least one of the devices or at least one circuit diode constituting the devices may be provided outside the single chip.

Then, an operation of an exemplary embodiment of the liquid crystal display will now be described in detail.

The signal controller 600 receives input image signals R, G and B from an external device, e.g., a graphic controller, (not illustrated) and an input control signal for controlling display thereof. The input image signals R, G and B include luminance information of each pixel PX of an image to be displayed, and the luminance information may include a gray scale level of a predetermined number of grayscale levels, for example, $1024=2^{10}$, $256=2^{8}$, or $64=2^{6}$ grayscale levels. In an exemplary embodiment, the input control signal may include a vertical synchronization signal Vsync, a horizontal synchronization signal Hsync, a main clock signal MCLK, a data enable signal DE, for example.

The signal controller 600 processes the input image signals R, G and B based on an operating condition of the liquid crystal panel assembly 300, and generates a gate control signal CONT1, a data control signal CONT2 and the like. The signal controller 600 transmits the gate control signal CONT1 to the gate driver 400, and transmits the data control signal CONT2 and the processed image signals R', G' and B' to the data driver 500.

The gate control signal CONT1 includes a scanning start signal that indicates a start of scanning and a clock signal that controls an output cycle of the gate-on voltage Von. The gate control signal CONT1 may further include an output enable signal that limits a maintaining time of the gate-on voltage Von.

The data control signal CONT2 includes a horizontal synchronization start signal that indicates a start of transmission of a digital image signal for the pixels PX in a row, a load signal that indicates application of an analog data voltage to the data lines D1-Dm, and a data clock signal. The data control signal CONT2 may further include a reverse signal that reverses a polarity of the data voltage in respect to the common voltage Vcom (hereinafter, referred to as "polarity of the data voltage for the common voltage").

Based on the data control signal CONT2 from the signal controller 600, the data driver 500 receives the processed image signals R', G' and B' for the pixels PX in a row, and selects a gray voltage corresponding to each of the processed image signals R', G' and B', and thus converts the processed image signals R', G' and B' into analog data voltages, and applies the converted analog data voltages to the corresponding data lines D1 to Dm.

The gate driver 400 applies the gate-on voltage Von to the gate lines G1 to Gn based on the gate control signal CONT1 from the signal controller 600 and turns on the switching element Q connected to the gate lines G1 to Gn. Then, the data voltage applied to the data lines D1 to Dm is applied to the corresponding pixel PX through the turned-on switching element Q.

A difference between the data voltage applied to the pixel PX and the common voltage Vcom determines a charging voltage, that is, a pixel voltage, of the liquid crystal capacitor Clc. The alignment of the liquid crystal molecules is changed or controlled based on a size of the pixel voltage, and thus polarization of light passing through the liquid crystal layer 3 is changed or controlled. The change in the polarization is represented as a change in transmittance of light by a polarizer, and the pixel PX indicates luminance indicated by a grayscale level of the digital image signal.

By repeating the aforementioned process in the unit of 1 horizontal period (which is also referred to as "1H", and is the same as one period of the horizontal synchronizing signal Hsync and the data enable signal DE), the gate-on voltage Von is sequentially applied to all of the gate lines G1 to Gn, and the data voltage is applied to all of the pixels PX, thereby displaying an image of a frame.

When one frame is finished, the state of the reverse signal applied to the data driver 500 may be controlled ("frame reverse") such that a next frame may start and the polarity of the data voltage applied to each pixel PX may be reversed to be opposite to the polarity of the previous frame. In such an embodiment, the polarity of the data voltage flowing through one data line may be periodically changed (for example, row reverse and dot reverse), or the polarities of the data voltage applied to one pixel row may be different from each other (for example, column reverse and dot reverse) based on a property of the reverse signal RVS in one frame.

In an exemplary embodiment of the invention, the common voltage Vcom generated by the common voltage generator 700 is an optimum common voltage at the highest grayscale level of the input image signal.

The optimum common voltage may be set by applying a predetermined grayscale level to the display, adjusting the common voltage while measuring flicker, and confirming a value in which the flicker is minimum. In such an embodiment, the optimum common voltage at the highest grayscale level, which minimizes the flicker when the highest grayscale level is applied to the display, is applied as the common voltage. The measurement of the common voltage may be performed at various points of the display panel, and an average of the measured values may be set to the optimum common voltage.

In such an embodiment, where the highest grayscale level of the input image signal is 1024, the optimum common voltage at the grayscale level of 1024 is applied to the common electrode of the liquid crystal display. In an alternative exemplary embodiment, where the highest grayscale level of the input image signal is 256, the optimum common voltage at the grayscale level of 256 is applied to the common electrode. In an alternative exemplary embodiment, where the highest grayscale level of the input image signal is 64, the optimum common voltage at the grayscale level of 64 is applied to the common electrode. The value of the common voltage generated in the common voltage generator 700 may have been input in a common voltage storage unit 710 in the common voltage generator 700.

Hereinafter, a size of the common voltage applied to an exemplary embodiment of the liquid crystal display according to the invention will be described in detail.

Figure 3:
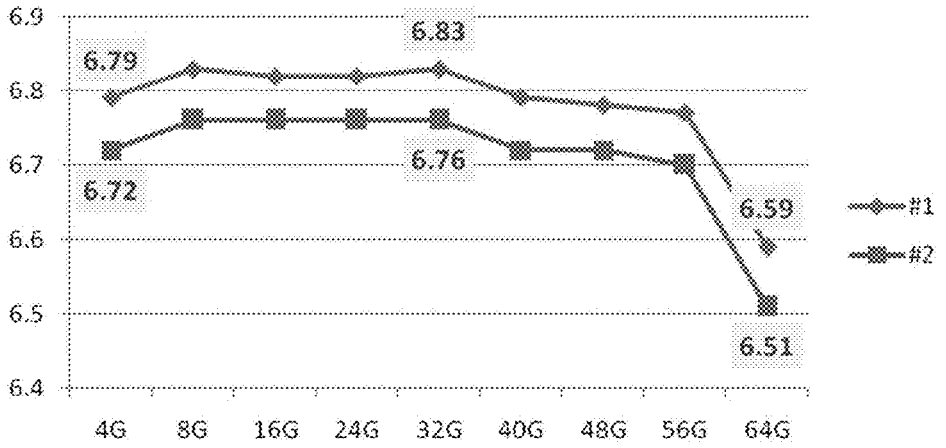
FIG. 3 is a graph illustrating an optimum common voltage measured for each grayscale level.

FIG. 3 is a graph illustrating an optimum common voltage measured for each grayscale level.

In FIG. 3, a horizontal axis represents various grayscale levels, and a vertical axis represents the optimum common voltages. Referring to FIG. 3, the optimum common voltages at the respective grayscale levels may be different from each other. The optimum common voltage for each grayscale level is performed by a method of measuring flicker in the display panel at a predetermined grayscale level. A value showing the minimum common voltage is measured as the optimum common voltage at a corresponding grayscale level by adjusting the common voltage while measuring flicker. In one exemplary embodiment, for example, a value of the common voltage is measured at five points in a display panel, and an average value of the values measured at the five points is set as a value of the optimum common voltage.

As described above, the optimum common voltages for the respective grayscale levels are different from each other. In a liquid crystal display, an afterimage may be generated due to the difference in the optimum common voltage for each grayscale level. In a liquid crystal display, an ion impurity in the liquid crystal layer may be adsorbed to the alignment layer by the difference between the optimum common voltage at each grayscale level and the common voltage that is applied to the display panel, such that an afterimage is recognized. The afterimage is referred to as a direct current ("DC") afterimage.

FIG. 4 is a diagram illustrating an optimum common voltage change in a comparative embodiment of the liquid crystal display.

In such a comparative embodiment of the liquid crystal display, an optimum common voltage at an intermediate grayscale level in the entire grayscale levels is set as the common voltage to be applied to the liquid crystal display. In a case where the highest grayscale level is 64, the optimum common voltage at a grayscale level of 32 is applied to the liquid crystal display.

Referring to FIG. 4, in a comparative embodiment of the liquid crystal display as described above, the optimum common voltage Vcom at the grayscale level of 32 is applied as the common voltage.

Referring back to FIG. 3, the optimum common voltage at the black grayscale level (1 G) (indicated by a dotted line in FIG. 4) is lower than the optimum common voltage at the intermediate grayscale level (32 G). Accordingly, the DC afterimage is generated at the black grayscale level by a difference between the optimum common voltage at the black grayscale level and the common voltage actually applied to the display. A size of the generated DC afterimage is substantially proportional to a difference between an area above a line of the common voltage Vcom and an area positioned below the line of the common voltage Vcom in FIG. 4.

In such a comparative embodiment, the optimum common voltage at the white grayscale level (64 G) is lower than the common voltage actually applied to the display. Accordingly, even in the white grayscale level, a center of the graph is generally positioned below the common voltage Vcom, and the DC afterimage is generated by a difference between an area positioned above the line of the common voltage Vcom and an area positioned below the line of the common voltage Vcom. In such a comparative embodiment, where the optimum common voltage is the same as the applied common voltage at the intermediate grayscale level (32 G), an area positioned above the line of the common voltage Vcom and an area positioned below the line of the common voltage Vcom are the same as each other in the intermediate grayscale level.

Referring to FIG. 4, a portion showing the large difference between the upper and lower areas based on the line of the common voltage Vcom is the white grayscale level (64 G). That is, the optimum common voltage is lower than the common voltage actually applied at each of the black grayscale level (1 G) and the white grayscale level (64 G), such that the graph corresponding to the white grayscale moves downwardly. However, a voltage variation width (i.e., a vertical length of the graph in FIG. 4) at the white grayscale level is the greatest, and a difference in an area based on the line of the common voltage Vcom is thereby larger at the white grayscale level than other grayscale level.

However, in an exemplary embodiment of the liquid crystal display according to the invention, the common voltage applied to the common electrode is the optimum common voltage at the white grayscale level.

Figure 5:
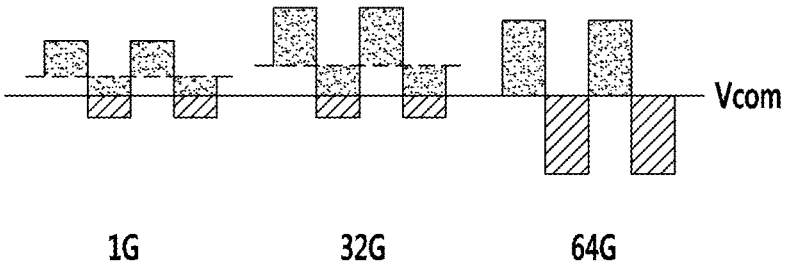
FIG. 5 is a diagram illustrating an optimum common voltage change in an exemplary embodiment of the liquid crystal display according to the inveniton.

FIG. 5 is a diagram illustrating the optimum common voltage change in an exemplary embodimetn of the liquid crystal display according to the invention. Referring to FIG. 5, in an exemplary embodiment of the liquid crystal display according to the invention, the common voltage is the optimum common voltage at the white grayscale level.

Accordingly, the optimum common voltage at the white grayscale level (64 G) is substantially the same as the common voltage applied to the liquid crystal display, such that the upper and lower areas based on the line of the common voltage Vcom are substantially the same as each other at the white grayscale level (64 G). Accordingly, the DC afterimage is not generated at the white grayscale level. However, the optimum common voltages at the black grayscale level (1 G) and the intermediate grayscale level (32 G) are higher than the common voltage Vcom applied to the liquid crystal display, such that the upper and lower areas based on the line of the common voltage Vcom are different from each other at the black grayscale level (1 G) and the intermediate grayscale level (32 G).

However, in such an embodiment of the invention, a width of voltage variation at the black grayscale level or the intermediate grayscale level is smaller compared to the width of voltage variation of the white grayscale level when the common voltage is set as the optimum common voltage at the intermediate grayscale level as in the comparative embodiment of FIG. 4. Accordingly, a difference in areas of upper and lower asymmetric portions based on the line of the common voltage Vcom are smaller in FIG. 5 than in FIG. 4. Accordingly, a size of the total DC afterimage in an exemplary embodiment of the invention is smaller than that of the comparative embodiment as shown in FIGS. 4 and 5.

In an exemplary embodiment of the liquid crystal display according to the invention, the optimum common voltage at the white grayscale level is applied as the common voltage to the common electrode, such that the DC afterimage is not generated at the white grayscale level. In such an embodiment, the common voltage is the optimum common voltage at the white grayscale level, such that a DC influence at the black grayscale level is slightly increased compared to a case where the optimum common voltage at the intermediate grayscale level is applied, but a black image is at the black grayscale level, such that the afterimage is not recognized even though the afterimage is generated. Accordingly, the afterimage is generally improved (e.g., the recognized afterimage is substantially reduced) by non-generation of the DC afterimage at the white grayscale level.

Figure 6:
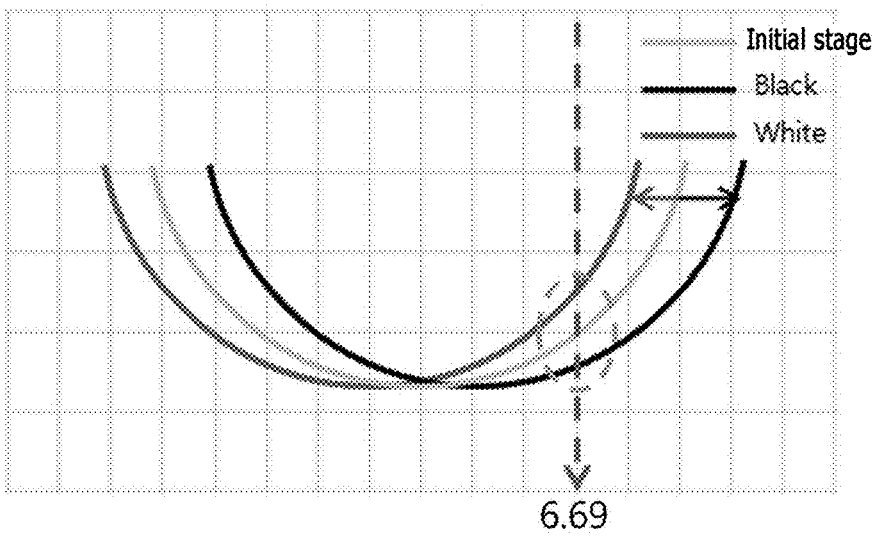
FIG. 6 is a diagram illustrating a change in a voltage when luminance of a comparative embodiment of the liquid crystal display is changed.

Then, an exemplary embodiment of the liquid crystal display of the invention will be described in greater detail with reference to FIGS. 6 and 7. FIG. 6 is a diagram illustrating a change in a voltage when luminance of a comparative embodiment of the liquid crystal display is changed, and FIG. 7 is a diagram illustrating a change in a voltage when luminance of an exemplary embodiment of the liquid crystal display according the invention is changed.

Figure 7:
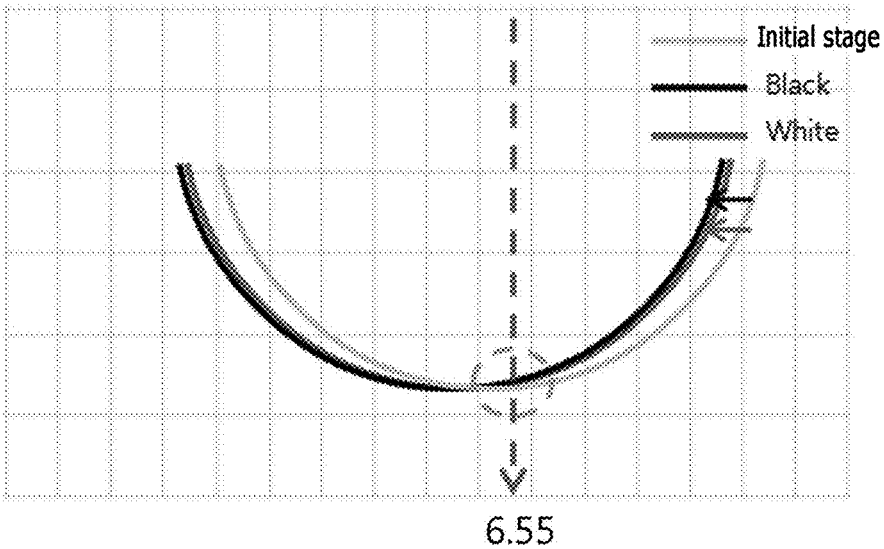
FIG. 7 is a diagram illustrating a change in a voltage when luminance of an exemplary embodiment of the liquid crystal display according to the invention is changed.

In FIGS. 6 and 7, a horizontal axis represents a voltage, and a vertical axis represents luminance.

In a comparative embodiment, as shown in FIG. 6, the optimum common voltage at the intermediate grayscale level (32 G) may be applied as the common voltage of the liquid crystal display. In such a comparatiev embodiment, about 6.69 V may be measured as the optimum common voltage at the intermediate grayscale level, and is applied thereto as the common voltage.

Referring to FIG. 6, the graph generally moves in a left direction in a case where the white grayscale level is displayed, and the graph generally moves in a right direction in a case where the black grayscale level is displayed compared to an initial state. In this case, a width of the movement in the left and right directions is recognized as the DC afterimage.

In an exemplary embodiment, as shown in FIG. 7, the optimum common voltage at the white grayscale level (64 G) may be applied as the common voltage of the liquid crystal display. In such an embodiment, about 6.55 volts (V) may be measured as the optimum common voltage at the white grayscale level, and is applied thereto as the common voltage.

Referring to FIG. 7, the graph equally moves in the left direction in a case where the white grayscale level and the black grayscale level are displayed compared to an initial state. As shown in FIG. 7, a width of the movement in an exemplary embodiment is substantially less than that of the comparative embodiment shown in FIG. 6. Accordingly, in an exemplary embodiment of the liquid crystal display according to the invention, the DC afterimage is decreased compared to that of the comparative embodiment.

The afterimage may be quantified through an experiment to confirm a numerical value improvement to show afterimage improvement in an exemplary embodiment of the liquid crystal display according to the invention. Hereinafter, afterimages of three liquid crystal displays having substantially the same configuration as each other except for the common voltage were measured through an experiment. In the experiment, a liquid crystal display where an optimum common voltage at the intermediate grayscale level is applied will be referred to as Comparative Embodiment 1, a liquid crystal display where a voltage decreased by about 0.2 V from the optimum common voltage at the intermediate grayscale level is applied as the common voltage will be referred to as Exemplary Embodiment 1, and a liquid crystal display where a voltage decreased by about 0.3 V from the optimum common voltage at the intermediate grayscale level is applied as the common voltage will be referred to as Exemplary Embodiment 2.

In Exemplary Embodiments 1 and 2, the voltages decreased by about 0.2 V and about 0.3 V compared to the optimum common voltage at the intermediate grayscale level, respectively, may be substantially the same as the optimum common voltage at the white grayscale level.

In the experiment, a voltage is applied to alternately display a black image and a white image on each display by a predetermined unit for about 128 hours. Thereafter, an image at the grayscale level of 128 is displayed on the entire screen, and then an afterimage is measured.

Figure 8:
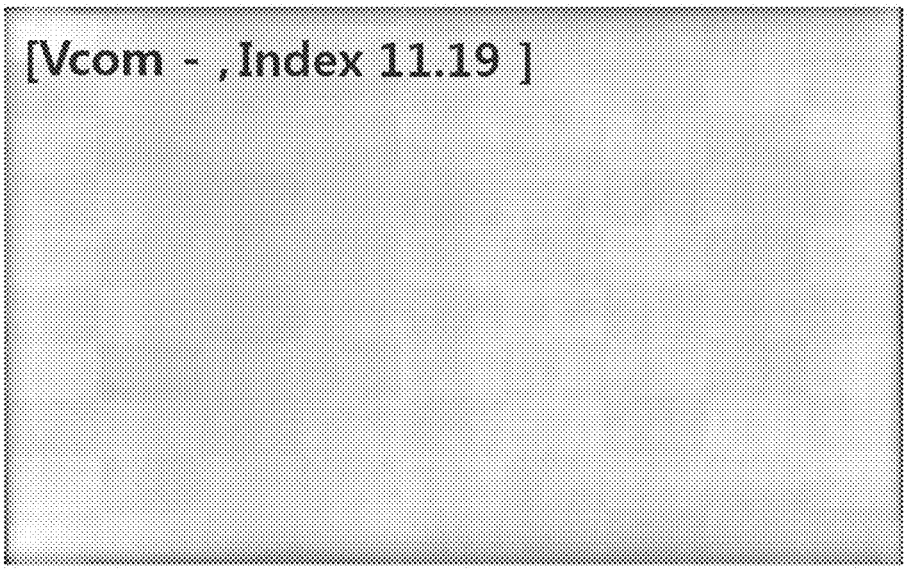
FIG. 8 is an image of an afterimage shown on a comparative emboidment of the liquid crystal display.
Figure 9:
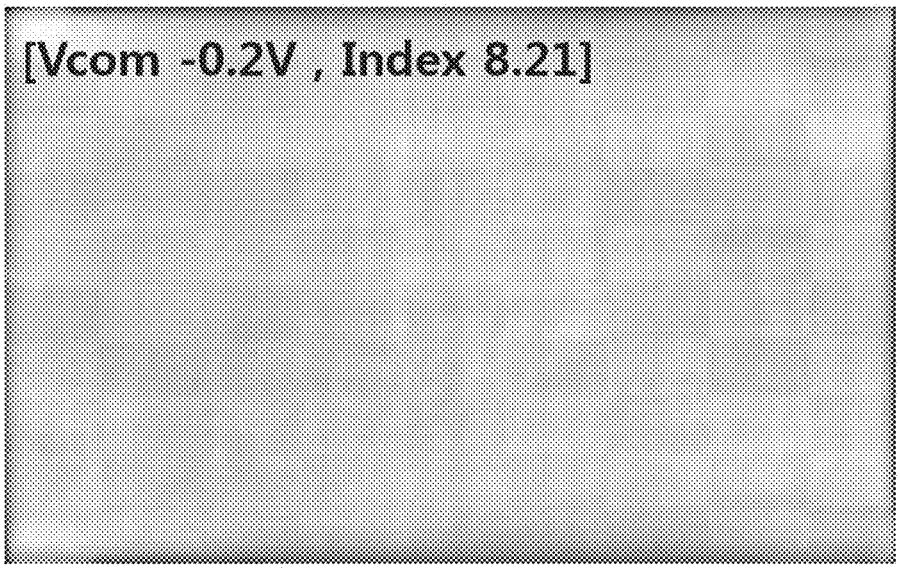
FIG. 9 is an image of an afterimage shown on an exemplary embodiment of the liquid crystal display according to the invention.
Figure 10:
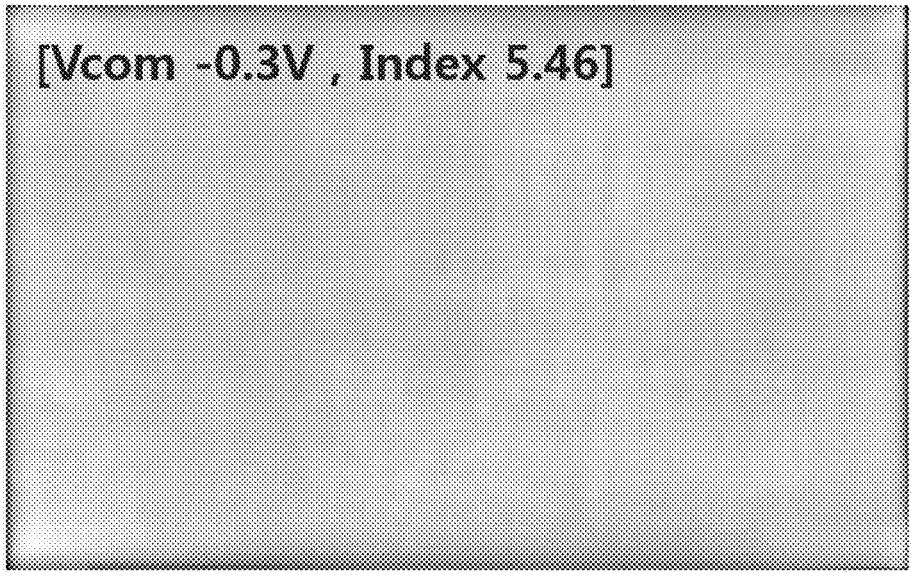
FIG. 10 is an image of an afterimage shown on another exemplary embodiment of the liquid crystal display according to the invention.

FIG. 8 is an image of an afterimage shown on a comparative embodiment of the liquid crystal display (e.g., Comparative Embodiment 1), and FIG. 9 is an image of an afterimage shown on an exemplary embodimetn of the liquid crystal display according to the invention (e.g., the Exemplary Embodiment 1). FIG. 10 is an image of an afterimage shown on an alterntaive exemplary embodiment of the liquid crystal display according to the invention (e.g., the Exemplary Embodmient 2). As shown in FIGS. 8 to 10, a boundary of the white image and the black image is clearly recognized in FIG. 8. However, a boundary of the white image and the black image is not clearly recognized in FIG. 10. That is, it can be seen by the naked eyes that the afterimage in Exemplary Embodiments is substantially decreased compared to that of the comparative embodiment.

In the experiment, the afterimages in the Comparative Embodiment 1 and Exemplary Embodiments 1 and 2 are measured by quantified numerical values. Referring to FIG. 8, the numerical value of the afterimage Index is shown as 11.19 in the Comparative Embodiment 1 in which the optimum common voltage at the intermediate grayscale level is applied thereto as the common votlage. Referring to FIG. 9, in the Exemplary Embodiment 1, where a voltage substantially close to the optimum common voltage at the white grayscale level is applied thereto as the common voltage, the numerical value of the afterimage Index is shown as 8.21. That is, the afterimage shown in FIG. 9 is improved compared to the afterimage shown in FIG. 8. Similarly, FIG. 10 shows Exemplary Embodiment 2, in which the optimum common voltage at the white grayscale level is applied thereto as the common voltage. Referring to FIG. 10, the numerical value of the afterimage Index of the Exemplary Embodiment 2 is shown as 5.46. Accordingly, in an exemplary embodiment, the afterimage of the liquid crystal display according to the invention is improved as shown in FIGS. 8 to 10.

Then, an exemplary embdoiment of a method of determining the optimum common voltage, according to the invention, will be described with reference to FIG. 11.

Figure 11:
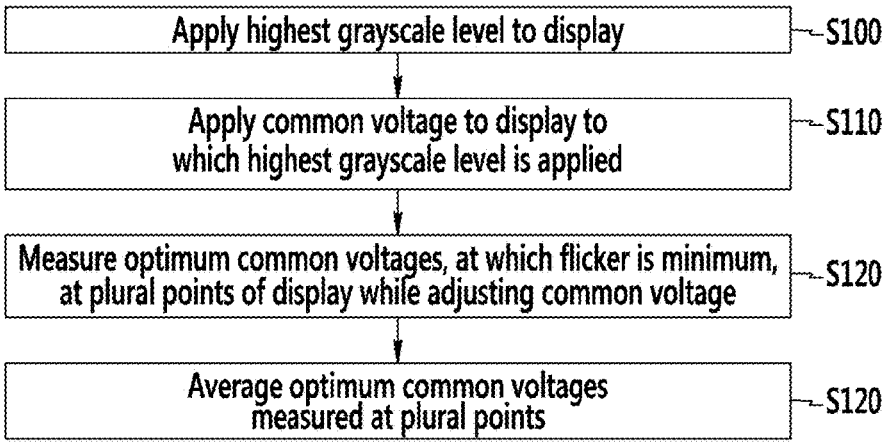
FIG. 11 is a flowchart illustrating an exemplary embodiment of a method of determining an optimum common voltage according to the invention.

FIG. 11 is a flowchart illustrating an exempalry embodiment of a method of determining an optimum common voltage, according to the invention.

Referring to FIG. 11, an exemplary embodiment of a method of determining an optimum common voltage according to the invention includes applying the highest grayscale level to a display (S100). In such an embodiment, when the highest grayscale level is applied to the display, a solid image having the highest grayscale level is displayed on the display.

In such an embodiment, the highest grayscale level is predetermined. In an exemplary embodiment, the highest grayscale level may be a grayscale level of 64, a grayscale level of 256, or a grayscale level of 1024, but is not limited thereto.

Next, the common voltage is applied to a display, to which the highest grayscale level is applied (S110). Flicker of the display is measured while adjusting the common voltage. In such an embodiment, the method includes measuring optimum common voltages, at which the flicker is minimum, at a plurality of points of the display while adjusting the common voltage (S120).

The plurality of points, at which the common voltage is measured, is defined in the display. In an exemplary embodiment, the plurality of points may be substantially uniformly disposed in the display. In one exemplary embodiment, for example, the common voltage may be measured at five points of the display panel. The flicker is measured while changing the common voltage applied to the display panel, and the optimum common voltage is measured at the point at which the flicker is minimum.

Next, an average of the optimum common voltages measured at the plurality of points is calculated (S130). An average value of the measured values is set as an optimum common voltage of the highest grayscale level.

The measurement may be performed after manufacturing the display, and a value of the measured optimum common voltage may be stored in the common voltage generator. Accordingly, when the display operates, a common voltage having a predetermined value corresponding to the value of the measured optimum common voltage is applied to the display panel.

As described above, in exemplary embodiments of the liquid crystal display according to the invention, the optimum common voltage at the white grayscale level is applied as the common voltage to the common electrode, such that the DC afterimage is not generated at the white grayscale level. The common voltage is the optimum common voltage at the white grayscale level, such that a DC influence at the black grayscale level is slightly increased compared to a case where the optimum common voltage at the intermediate grayscale level is applied as the common voltage, but when a black image at the black grayscale level is displayed the afterimage is not recognized even though the afterimage is generated. Accordingly, the overall afterimage is substantially improved by non-generation of the DC afterimage at the white grayscale level.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display, comprising:

a display panel comprising:

a plurality of pixels arranged substantially in a matrix form;

a plurality of gate lines connected to the pixels; and a plurality of data lines connected to the pixels; and a common voltage generator which generates a common voltage and applies the common voltage to the display panel, wherein the common voltage generated from the common voltage generator is the same for all grayscale levels of a predetermined number of grayscale levels and is the same as an optimum common voltage at a highest grayscale level of the predetermined number of grayscale levels which minimizes a flicker at the highest grayscale level, and wherein the display panel has different optimum common voltages between a lowest grayscale level and the highest grayscale level of the predetermined number of grayscale levels.

2. The liquid crystal display of claim 1, wherein the common voltage generator comprises a common voltage storage unit which stores a value of the optimum common voltage at the highest grayscale level.

3. The liquid crystal display of claim 2, wherein the optimum common voltage at the highest grayscale level is defined as an average value of optimum common voltages at the highest grayscale level measured at five positions of the display panel after the liquid crystal display is manufactured.

4. The liquid crystal display of claim 3, wherein a difference between the optimum common voltage measured at the highest grayscale level and an optimum common voltage measured at a grayscale level lower than the highest grayscale level is equal to or less than about 0.3 volt.

5. The liquid crystal display of claim 4, wherein the optimum common voltage measured at the highest grayscale level is lower than the optimum common voltage measured at the grayscale level lower than the highest grayscale level.

6. The liquid crystal display of claim 2, wherein the highest grayscale level is a grayscale level of 64.

7. The liquid crystal display of claim 2, wherein the highest grayscale level is a grayscale level of 256.

8. The liquid crystal display of claim 2, wherein the highest grayscale level is a grayscale level of 1024.

9. The liquid crystal display of claim 2, wherein when the liquid crystal display displays the highest grayscale level, a residual direct current in the display panel is substantially zero.

10. The liquid crystal display of claim 9, wherein when the liquid crystal display displays the highest grayscale level, no surface afterimage is shown.

11. The liquid crystal display of claim 2, further comprising:

a gray voltage generator configured to generate a plurality of gray voltages; and a data driver configured to apply a gray voltage corresponding to an image signal among the gray voltages to the pixels as a data voltage.

12. A method of determining an optimum common voltage of a display apparatus, the method comprising:

applying a highest grayscale level of a predetermined number of grayscale levels to the display apparatus;

applying a common voltage to the display apparatus, to which the highest grayscale level is applied;

measuring a value of the common voltage, at which a flicker in the display apparatus is minimum, at a plurality of regions of the display apparatus while adjusting the value of the common voltage; and averaging values of the common voltage measured at the regions, respectively, wherein optimum common voltages vary between a lowest grayscale level and the highest grayscale level of the predetermined number of grayscale levels wherein the common voltage generated from the common voltage generator is the same for all grayscale levels of a predetermined number of grayscale levels and is the same as an optimum common voltage at a highest grayscale level of the predetermined number of grayscale levels.

13. The method of claim 12, wherein the regions are five points on a display panel of the display apparatus.

14. The method of claim 12, wherein the highest grayscale level is a grayscale level of 64.

15. The method of claim 12, wherein the highest grayscale level is a grayscale level of 256.

16. The method of claim 12, wherein the highest grayscale level is a grayscale level of 1024.

17. The method of claim 12, further comprising:

storing the averaged value of the common voltage in a common voltage storage unit of the display apparatus.

18. The liquid crystal display of claim 1, wherein the display panel has different optimum common voltages between a white image and a black image.

19. The method of claim 12, wherein the display apparatus has different optimum common voltages between a white image and a black image.

* * * * *